United States Patent [19]

Hannibal et al.

[11] Patent Number: 4,569,639

[45] Date of Patent: Feb. 11, 1986

[54] OIL DISTRIBUTION SYSTEM FOR A COMPRESSOR

[75] Inventors: Billy B. Hannibal; Thomas A. Jacoby, both of Tecumseh, Mich.

[73] Assignee: Tecumseh Products Company, Tecumseh, Mich.

[21] Appl. No.: 755,938

[22] Filed: Jul. 16, 1985

Related U.S. Application Data

[63] Continuation of Ser. No. 601,731, Apr. 18, 1984, abandoned, which is a continuation of Ser. No. 374,087, May 3, 1982, abandoned.

[51] Int. Cl.[4] ..... F04B 17/00

[52] U.S. Cl. ..... 417/368; 417/902

[58] Field of Search ..... 417/368, 372, 902; 418/85; 184/6.16, 6.18

[56] References Cited

U.S. PATENT DOCUMENTS

| | | |
|---|---|---|
| 2,050,385 | 8/1936 | Schmidt . |
| 2,125,645 | 8/1938 | Money . |
| 2,198,258 | 4/1940 | Money . |
| 2,219,199 | 10/1940 | Renner . |
| 2,500,751 | 3/1950 | Halfvarson . |
| 2,504,528 | 4/1950 | Hume . |
| 2,587,246 | 2/1952 | Touborg . |
| 2,628,016 | 2/1953 | Higham . |
| 3,125,184 | 3/1964 | Valbjorn . |
| 3,182,901 | 5/1965 | Solomon . |
| 3,187,994 | 6/1965 | Valbjorn . |
| 3,194,490 | 7/1965 | Roelsgaard . |
| 3,285,504 | 11/1966 | Smith . |
| 3,396,903 | 8/1968 | Oya . |
| 3,410,478 | 11/1968 | Geisenhaver . |
| 3,451,615 | 6/1969 | Hover . |
| 3,454,213 | 7/1969 | Valbjorn . |
| 3,476,308 | 11/1969 | Rundell . |
| 3,491,939 | 1/1970 | Larsen . |
| 3,587,781 | 6/1971 | Leffers . |
| 3,674,382 | 7/1972 | Kubota . |
| 3,848,702 | 11/1974 | Bergman . |
| 4,236,879 | 12/1980 | Abe . |

FOREIGN PATENT DOCUMENTS

| | | |
|---|---|---|
| 873558 | 4/1953 | Fed. Rep. of Germany . |
| 938313 | 1/1956 | Fed. Rep. of Germany . |
| 1551285 | 4/1970 | Fed. Rep. of Germany . |
| 871115 | 3/1941 | France . |
| 1156042 | 12/1958 | France . |
| 56337 | 6/1968 | Luxembourg . |
| 576016 | 3/1946 | United Kingdom . |

*Primary Examiner*—Carlton R. Croyle
*Assistant Examiner*—Donald E. Stout
*Attorney, Agent, or Firm*—Albert L. Jeffers; Anthony Niewyk

[57] ABSTRACT

In a refrigeration compressor having at least one piston-cylinder arrangement therein for compressing gaseous refrigerant, an elongated, tube extending upwardly from a lubricant passage in the crankshaft for slinging oil radially, outwardly therefrom, and a lubricant deflector upstanding from the cylinder head to deflect slung oil over exterior surfaces of the cylinder head for conducting heat energy therefrom.

9 Claims, 6 Drawing Figures

OIL DISTRIBUTION SYSTEM FOR A COMPRESSOR

This is a continuation of application Ser. No. 601,731, filed Apr. 18, 1984, now abandoned, which was a continuation of Ser. No. 374,087, filed May 3, 1982 now abandoned.

BACKGROUND OF THE INVENTION

This invention relates to hermetically sealed refrigeration compressors, and more particularly to an oil distribution system for such compressors adapted to conduct heat energy from the cylinder heads within the compressor housings.

In those refrigeration compressors utilizing a piston-cylinder arrangement for compression, the gaseous refrigerant becomes extremely hot upon compression and conducts heat energy to the cylinder and cylinder head, thereby increasing temperatures of the cylinder and cylinder head. These higher temperatures may cause lubricant to boil and lose its lubricating properties, which eventually results in carbon deposits forming on valves, valve seats, leaf plates and the like. The steady accumulation of such deposits will eventually destroy the integrity of the valve arrangement requiring shutdown of the compressor and replacement of the defective parts.

Generally, the cooling of the cylinder head is left to the suction inlet refrigerant that is delivered directly into the compressor housing. Although adequate to acceptably cool the cylinder head, higher compressor efficiencies are obtainable if the cylinder head is cooled even further.

The most relevant prior art of which applicants are aware is U.S. Pat. No. 2,215,645 issued to Money on Aug. 2, 1938. Money has a short tube extending upwardly from the top opening of the oil passage in the crankshaft that serves to spray oil upon the top surfaces of compressor components. To insure that some of the oil will fall upon the outer surfaces of the piston and cylinder to lubricate them, a baffle is connected to the top of the cylinder to deflect some the sprayed oil so that it may drip downwardly onto the outer surfaces of the piston. It appears that the majority of the oil which is sprayed over the baffle impacts the compressor housing to return to the oil sump in the bottom of the compressor. It should be noted that the baffle in the Money patent is disposed on the most axially inwardly portion of the cylinder to insure deflection of oil to lubricate the piston.

The copending application Ser. No. 374,050, now abandoned, of Billy B. Hannibal, a coinventor of the present invention, is of particular relevance regarding the present invention. In the earlier invention of the copending application the applicant has provided for the cooling of oil pumped upwardly through an oil passage in a crankshaft by fitting an elongated, hollow tube into the oil passage. Oil is pumped upwardly through the tube and, by angularly adjusting the tube relative to the crankshaft rotational axis, slung radially outwardly against the side upper surfaces of the compressor housing to cool the oil as it returns to the sump. Although a portion of the slung oil may contact the cylinder and cylinder head, any cooling experienced by those parts is extremely slight and particularly so with reference to the cylinder head, which may receive none of the oil.

Other devices have been used to decrease the extremely high temperatures of the cylinder head, for example, heat radiation fins disposed on the cylinder head, which have been effective in various degrees in lowering the cylinder head temperature. However, further cylinder head temperature reduction is desirable in order to increase compressor efficiency, prevent accumulation of carbon deposits on the valve arrangements, and prolong the life of parts such as bearings, insulation and the like.

SUMMARY OF THE INVENTION

One technique for maintaining the discharge valve temperature low enough to prevent an accumulation of carbon deposits is to transfer heat energy from the cylinder head expeditiously. This invention accomplishes such heat transfer by bathing the cylinder head with a flow of oil.

The present invention remedies the above problem of extremely high cylinder head temperatures by providing an oil deflector on the cylinder head, which is preferably cast of aluminum, to direct slung oil to the cylinder head side and end exterior surfaces to conduct heat therefrom. To insure that a portion of the slung oil collects and flows downwardly over the end surfaces of the cylinder head the deflector is provided with at least one opening therein through which some of the slung oil may pass.

Also provided with the present invention is an opening disposed through the side of an elongated, hollow body extending upwardly from the oil passage in the top of the crankshaft. The hole is disposed approximately level with the deflector on the cylinder head to provide a generally horizontal spray of oil thereto upon rotation of the crankshaft. The position of the hole in the tube may be varied above the oil deflector to compensate for varying centrifugal speeds and angular adjustments of the elongated, hollow body.

Upon rotation of the crankshaft, a portion of the oil pumped upwardly through the elongated body is slung generally radially outwardly through the opening in the side of the body, and, upon reaching the vertically disposed oil deflector on the cylinder head, deflected by the oil deflector to flow over the side and end exterior surfaces of the cylinder head to conduct heat therefrom.

Broadly stated, the present invention provides in combination with a compressor including a hermetically sealed housing having a crankcase therein with a cylinder disposed in the crankcase and a sump in the bottom of the housing, a crankshaft rotatably received in the crankcase and having a piston operably connected thereto and disposed in the cylinder, the crankshaft having centrifugal pump means connected to its bottom portion and disposed in the sump and having means connected to its upper portion for slinging lubricant radially outwardly therefrom, a lubricant deflector device comprising means on and vertically upstanding from the cylinder head to direct a portion of the lubricant slung by the slinging means to the cylinder head to conduct heat energy therefrom.

It is an object of the present invention to provide significant additional cooling to the cylinder head, and particularly to the cylinder head, of a refrigeration compressor, thereby increasing the compressor's efficiency, preventing the premature accumulation of carbon deposits on valve arrangements, and increasing the useful life of bearings, insulation and the like.

BRIEF DESCRIPTION OF THE DRAWINGS

The above mentioned and other features and objects of this invention, and the manner of obtaining them will become more apparent and the invention itself will be better understood by reference to the following description of an embodiment of the invention taken in conjunction with the accompanying drawings, wherein.

DESCRIPTION OF A PREFERRED EMBODIMENT

Figure 1:
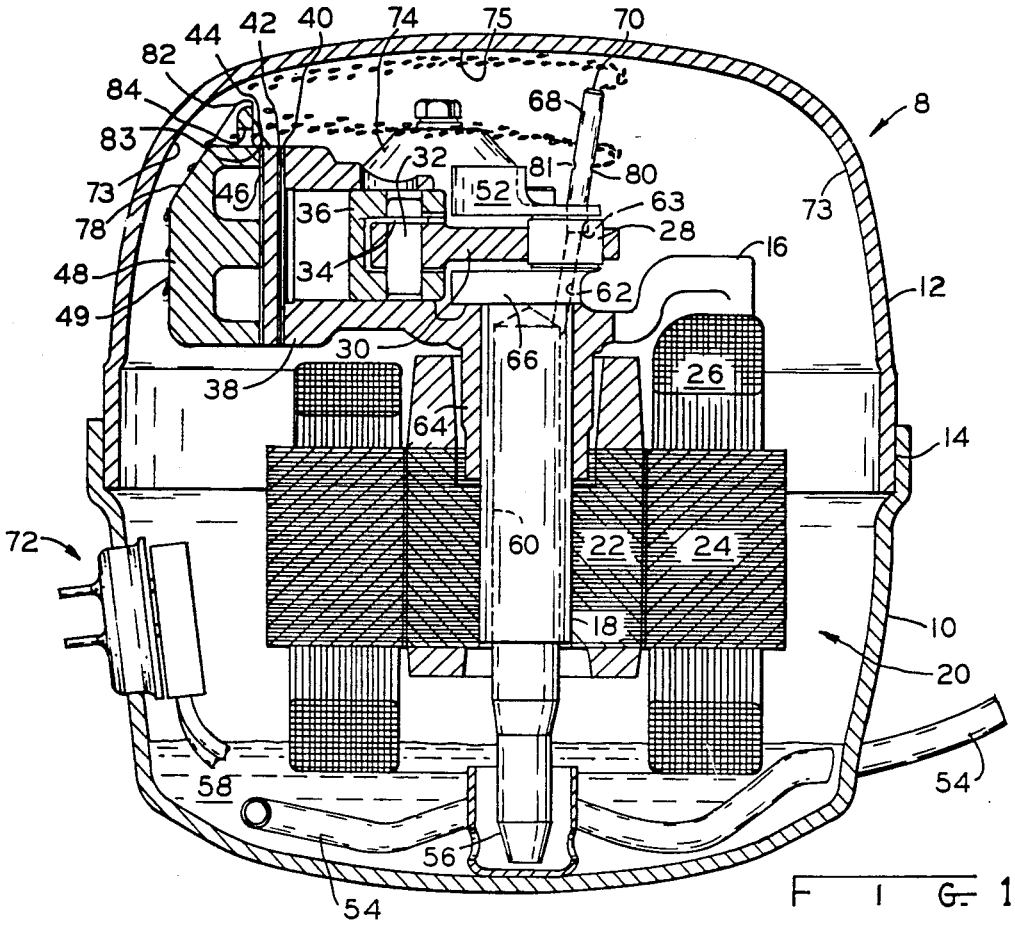
FIG. 1 is a sectional view of FIG. 2 along line 1—1 and viewed in the direction of the arrows.
Figure 2:
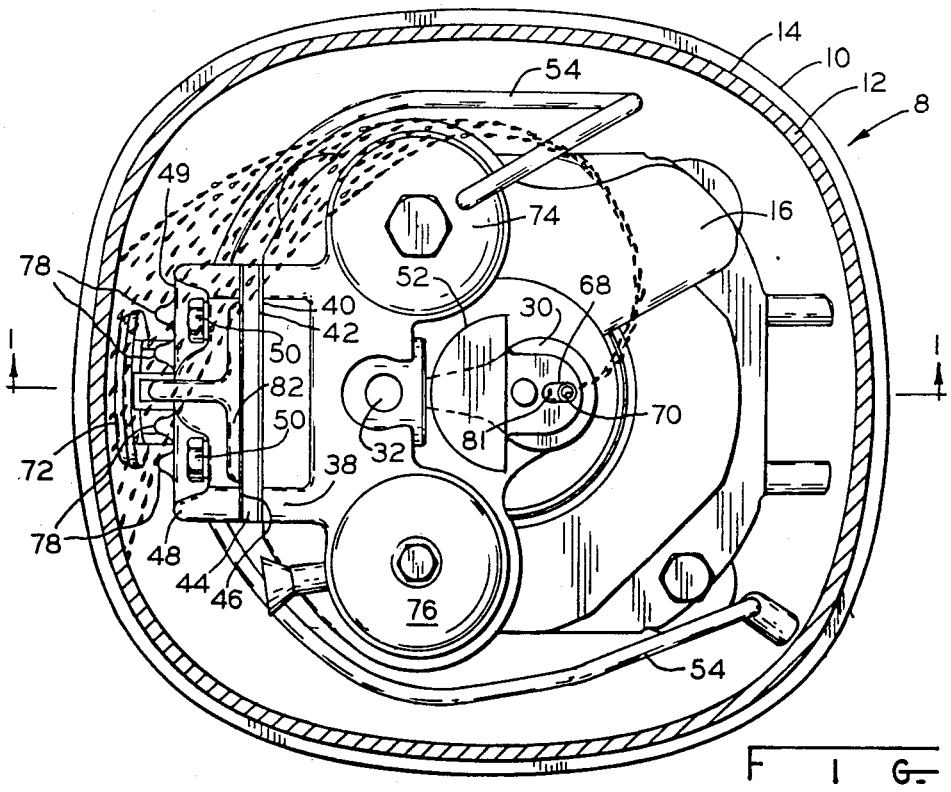
FIG. 2 is a broken-away, top plan view of FIG. 1.
Figure 3:
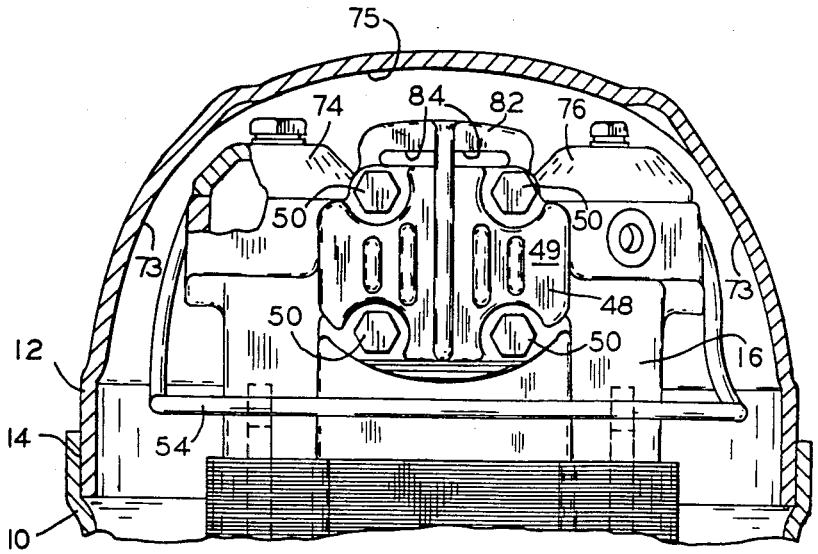
FIG. 3 is a broken-away, elevational view of the upper portion of a compressor viewed from the left side of FIG. 1.

Referring to the drawings, and particularly FIG. 1, conventional compressor 8 comprises a lower housing 10 and upper housing 12, which may be welded or brazed at seam 14. Mounted within compressor 8 is crankcase 16 having crankshaft 18 rotatably received therethrough, and a motor 20 comprising rotor 22 secured to crankshaft 18 and stator 24 with field windings 26.

The upper portion of crankshaft 18 has closed-loop end 28 of connecting rod 30 connected thereto and which has its opposite end connected by wrist pin 32 and spring clip 34 to piston 36 disposed in cylinder 38 of crankcase 16. Cylinder 38 has connected thereto gasket 40, leaf plate 42, valve plate 44, gasket 46, and cylinder head 48 by four bolts 50. The piston-cylinder arrangement is dynamically balanced by counterweight 52 connected to crankshaft 18.

Disposed in lower housing 10, along with refrigerant tubing 54, is oil pump 56 which is connected to the bottom end portion of crankshaft 18 in oil sump 58. Crankshaft 18 has axially disposed therein oil passage 60 and upper oil passage 62 for delivering oil to lubricate typical points, such as main bearing 64 and thrust bearing 66.

During operation, very high temperature exist within compressor 8 causing the components therein, for example, motor 20, crankcase main bearing 64, crankshaft bearing 66, and most particularly cylinder head 48 to become extremely hot, thereby requiring cooling.

Generally, the cooling of the above mentioned parts is accomplished by oil pump 56 pumping oil from oil sump 58 upwardly through oil passage 60 to not only lubricate points, such as crankcase main bearing 64 and crankshaft bearing 66, but also to conduct heat energy from motor 20, crankcase main bearing 64, crankshaft bearing 66, and other parts connected or in close proximity to crankshaft 18. Upon termination of its upward travel through oil passage 60 or upper oil passage 62, the oil is returned to oil sump 58 at very high temperatures, and, if not properly cooled, may prematurely lose its lubricating properties, thereby possibly resulting in the early failure of wrist pin, bearings and the like.

A unique means of cooling the oil is provided by oil slinger tube 68, which is fitted in opening 63 of upper oil passage 62 in the top end of crankshaft 18. In the present embodiment, slinger 68 is angularly disposed relative to the rotational axis of crankshaft 18. Slinger 68 is of a predetermined length for reasons which will be discussed below and has opening 70 disposed therein, which, as measured from the rotational axis of crankshaft 18, has an effective radius longer than the effective radius of crankshaft 18.

The cooling of the oil takes place upon motor 20 being energized through conventional multi-pin terminal 72, which causes rotor 22 to rotate crankshaft 18 and oil pump 56. As the oil is pumped upwardly by oil pump 56 through oil passage 60 and upper oil passage 62, a portion of the oil will be urged upwardly through slinger 68 and opening 70 to be slung generally upwardly and radially outwardly against side surfaces 73 of upper housing 12. Because both lower housing 10 and upper housing 12 are cooler than the oil, heat energy will be conducted from the oil to housings 10 and 12 thereby cooling the oil as it flows downwardly to oil sump 58. To insure the oil being slung by slinger 68 does not impact top surfaces 75 of upper housing 12, and consequently drip downwardly upon compressor parts, such as discharge muffler cover 74, suction muffler cover 76, and the other above mentioned parts, slinger 68 is made of a rigid material that allows it to be angularly oriented from the vertical to direct the spray of oil away from top surface 75 and toward side surfaces 73 of upper housing 12. Furthermore, should certain compressor parts be disposed above the top end of crankshaft 18, as illustrated in FIG. 1, slinger 68 may be manufactured having a predetermined length which will insure opening 70 being above such parts, thereby preventing the existence of any obstruction in the path of the oil being slung by slinger 68.

To reiterate, slinger 68, due to its angular orientation relative to the rotational axis of crankshaft 18 and the increased effective radius of opening 70, is able to sling the oil against the surfaces 73 of upper housing 12. In addition, slinger 68 is bent to allow directional control of the spray path of the oil exiting opening 70 for various compressor models.

It was earlier mentioned that cylinder head 48 experiences extremely high temperatures during the operation of compressor 8. This is primarily due to the temperature existing within the interior space of compressor 8 and the high temperatures produced within cylinder 38 upon compression of gaseous refrigerant. Conventional means to alleviate the extremely high temperatures experienced by cylinder head 48 include disposing a plurality of fins 78 on cylinder head 48 to conduct the heat energy therefrom to the interior space of compressor 8. In spite of this, cylinder head 48 may still remain at undesirable temperatures during the operation of compressor 8.

To reduce the temperature of cylinder head 48, bleed holes 80 and 81 are disposed in the side of oil slinger tube 68, with bleed hole 80 facing radially outwardly therefrom. Because slinger 68 rotates with crankshaft 18, bleed hole 80 will always rotate facing towards upper housing 12. This permits a portion of the oil traveling upwardly through slinger 68 to be slung generally horizontally, radially outwardly through bleed hole 80. As slinger 68 rotates past cylinder head 48, a spray of oil is slung from bleed hole 80 onto cylinder head for cooling purposes. Little oil is slung from hole 81 since it faces radially inwardly towards the rotational axis of crankshaft 18. Hole 81 is present only because of manufacturing expediency.

To insure that a portion of the oil slung from bleed hole 80 flows over end portion 49 of cylinder head 48 and ribs 78 disposed thereon, a deflector and heat sink flange member 82 having slots 84 disposed in the surface 83 thereof that faces tube 68 is vertically disposed on the top surface of cylinder head 48. Slots 84 extend through deflector 82. Consequently, upon slinger 68 rotating past cylinder head 48 a portion of oil is caught by deflector 82 and caused to flow over the surfaces of cylinder head 48 adjacent valve plate 44, while at the same time allowing a remaining portion of the oil to pass through slots 84 and to flow over end portion 49 of cylinder head 48 and ribs 78.

Figure 5:
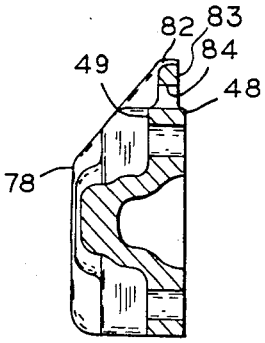
FIG. 5 is a sectional view of FIG. 4 along line 5—5 as viewed in the direction of the arrows.
Figure 4:
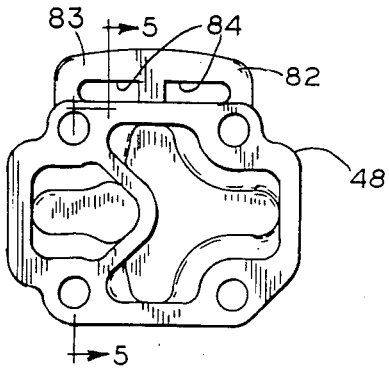
FIG. 4 is an internal view of the cylinder head of the compressor.
Figure 6:
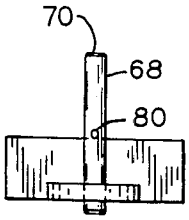
FIG. 6 is a side elevational view of an oil tube disposed in the oil passage of a crankshaft.

As illustrated in FIGS. 1 and 5, deflector 82 is vertically disposed on the top surface portion of cylinder head 48 adjacent gasket 46. Deflector 82 could be disposed on the top surface of cylinder head 48 adjacent end portion 49, however, due to the small confines generally existing between cylinder head 48 and upper housing 12, it has been found that deflector 82 performs its desired function most efficiently when disposed adjacent gasket 46. Furthermore, deflector 82 is of a predetermined height and desirably disposed away from housing 10 to allow for production tolerences.

While this invention has been described as having a specific embodiment, it will be understood that it is capable of further modification. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. In combination with a compressor including a hermetically sealed housing having a crankcase therein with a cylinder disposed in said crankcase and a sump in a bottom portion thereof, a vertically disposed crankshaft rotatably received in said crankcase and having a piston operably connected thereto and disposed in said cylinder, a cylinder head, said crankshaft having pump means connected to its bottom portion and disposed in said sump for pumping lubricant from said sump upwardly through a lubricant passage in said crankshaft, a lubricant distribution system comprising:

a generally elongated hollow body connected to said rotatable crankshaft and in communication with said lubricant passage and having an opening through which lubricant is thrown radially outwardly upon rotation of said crankshaft, and means on and vertically upstanding from said cylinder head for directing a portion of the lubricant slung by said generally elongated hollow body to said cylinder head to conduct heat energy therefrom.

2. The compressor of claim 1 wherein said directing means is a flange member and including at least one opening therein to allow passage therethrough of lubricant to conduct heat energy from said cylinder head.

3. The compressor of claim 2 wherein said flange member is in direct thermal contact with said cylinder head.

4. The compressor of claim 1 wherein said hollow body is connected to said crankshaft at a lower end and said opening is an axial opening in an upper end of said body; an upper portion of said hollow body is angularly disposed relative to the axis of rotation of said crankshaft to dispose said upper end upwardly and radially outwardly from said crankshaft; said body having a second radially outward facing opening means in a side thereof for propelling lubricant radially outwardly therefrom and against said directing means.

5. The compressor of claim 4 wherein said directing means is a flange member on and vertically upstanding from said cylinder head and having at least one opening therein to allow lubricant to pass therethrough to conduct heat energy from said cylinder head.

6. The compressor of claim 5 wherein said flange member includes a surface facing inwardly toward said body, and said flange member opening is in said inwardly facing surface.

7. In combination with a compressor including a hermetically sealed housing having a crankcase therein with a cylinder disposed in said crankcase and a sump in a bottom portion thereof, a cylinder head, a vertical crankshaft rotatably received in said crankcase and having a piston operably connected thereto and disposed in said cylinder, said crankshaft having centrifugal pump means connected to its bottom portion and disposed in said sump for pumping lubricant from said sump upwardly through a lubricant passage in said crankshaft, said crankshaft having means connected to its upper portion for slinging lubricant radially outwardly therefrom, a lubricant deflector comprising:

means on and vertically upstanding from said cylinder head and in direct thermal contact with said cylinder head for catching a portion of the lubricant slung by said slinging means to conduct heat energy from said cylinder head.

8. The compressor of claim 7 wherein said means for catching is a flange member and including at least one opening therein to allow passage therethrough of lubricant to conduct heat energy from said cylinder head.

9. In a compressor including a hermetically sealed housing having a crankcase therein with a cylinder disposed in said crankcase and a sump in a bottom portion thereof, a vertical crankshaft rotatably received in said crankcase and having a piston operably connected thereto and disposed in said cylinder, a cylinder head, said crankshaft having pump means connected to its bottom portion and disposed in said sump for pumping lubricant from said sump upwardly through a lubricant passage in said crankshaft, a lubricant distribution system comprising:

a generally hollow body connected to said crankshaft and in communication with said lubricant passage and having an upper end opening through which lubricant is thrown against the housing, said body including a side opening through which lubricant is thrown radially outwardly as the crankshaft rotates, and heat sink means on and vertically upstanding from said cylinder head and in direct thermal contact therewith for catching at least a portion of the lubricant thrown out of said side opening to thereby conduct heat away from said cylinder head to the lubricant.

* * * * *